US008676077B2

(12) United States Patent
Matsuzuki et al.

(10) Patent No.: US 8,676,077 B2
(45) Date of Patent: Mar. 18, 2014

(54) OPTICAL FIXING APPARATUS, IMAGE FORMING APPARATUS, AND OPTICAL FIXING METHOD

(75) Inventors: Masato Matsuzuki, Kanagawa (JP); Tetsuro Kodera, Kanagawa (JP); Akira Sakamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 205 days.

(21) Appl. No.: 13/366,619

(22) Filed: Feb. 6, 2012

(65) Prior Publication Data

US 2013/0045019 A1 Feb. 21, 2013

(30) Foreign Application Priority Data

Aug. 16, 2011 (JP) ..... 2011-177943

(51) Int. Cl.
*G03G 15/20* (2006.01)

(52) U.S. Cl.
USPC ..... 399/67; 399/33; 399/122; 399/320

(58) Field of Classification Search
USPC ..... 399/33, 67, 122, 320
See application file for complete search history.

(56) References Cited

U.S. PATENT DOCUMENTS

2001/0006584 A1 7/2001 Yoshida et al.
2011/0044740 A1 2/2011 Matsubara et al.

FOREIGN PATENT DOCUMENTS

JP 2001-249506 A 9/2001
JP 2011-043609 A 3/2011

*Primary Examiner* — Walter L Lindsay, Jr.
*Assistant Examiner* — Roy Y Yi
(74) *Attorney, Agent, or Firm* — Sughrue Mion, PLLC

(57) ABSTRACT

An optical fixing apparatus includes a transport unit that transports a recording medium in a first direction in a first fixing process and a second fixing process subsequent thereto and transports the recording medium in a second direction after the first fixing process and before the second fixing process; a light irradiating unit that irradiates the recording medium with light having a predetermined intensity while the recording medium is transported in the first and second fixing processes; a controller that performs a control so that the intensity of the light is lower than the predetermined intensity in a first period before the end of the first fixing process and a second period after the start of the second fixing process, and so that an area of the recording medium irradiated in the first period and an area of the recording medium irradiated in the second period overlap.

6 Claims, 7 Drawing Sheets

OPTICAL FIXING APPARATUS, IMAGE FORMING APPARATUS, AND OPTICAL FIXING METHOD

CROSS-REFERENCE TO RELATED APPLICATIONS

This application is based on and claims priority under 35 USC 119 from Japanese Patent Application No. 2011-177943 filed Aug. 16, 2011.

BACKGROUND (i) Technical Field

The present invention relates to an optical fixing apparatus, an image forming apparatus, and an optical fixing method.

(ii) Related Art

Image forming apparatuses that form an image on a continuous recording medium (also called a continuous medium) by an electrophotographic process while transporting the recording medium is known. In such an image forming apparatus, a toner image formed on an image carrier, such as a photoconductor drum, is transferred onto the recording medium and fixed to the recording medium by melting the toner image that has been transferred onto the recording medium with heat. Thus, an image is formed on the recording medium.

SUMMARY

According to an aspect of the invention, there is provided an optical fixing apparatus including a transport unit, a light irradiating unit, and a controller. The transport unit transports a recording medium that carries an image transferred onto the recording medium in a first direction in a first fixing process and a second fixing process subsequent to the first fixing process and transports the recording medium in a second direction after the first fixing process and before the second fixing process, the second direction being opposite to the first direction. The light irradiating unit irradiates the recording medium with light having a predetermined intensity while the recording medium is transported in the first direction by the transport unit in the first fixing process and the second fixing process. The controller controls the light irradiating unit so that the intensity of the light from the light irradiating unit is lower than the predetermined intensity in a predetermined first period before the end of the first fixing process and a predetermined second period after the start of the second fixing process, and so that an area of the recording medium that is irradiated with the light from the light irradiating unit in the first period and an area of the recording medium that is irradiated with the light from the light irradiating unit in the second period overlap.

BRIEF DESCRIPTION OF THE DRAWINGS

An exemplary embodiment of the present invention will be described in detail based on the following figures, wherein.

DETAILED DESCRIPTION

Exemplary Embodiment

Structure

Figure 1:
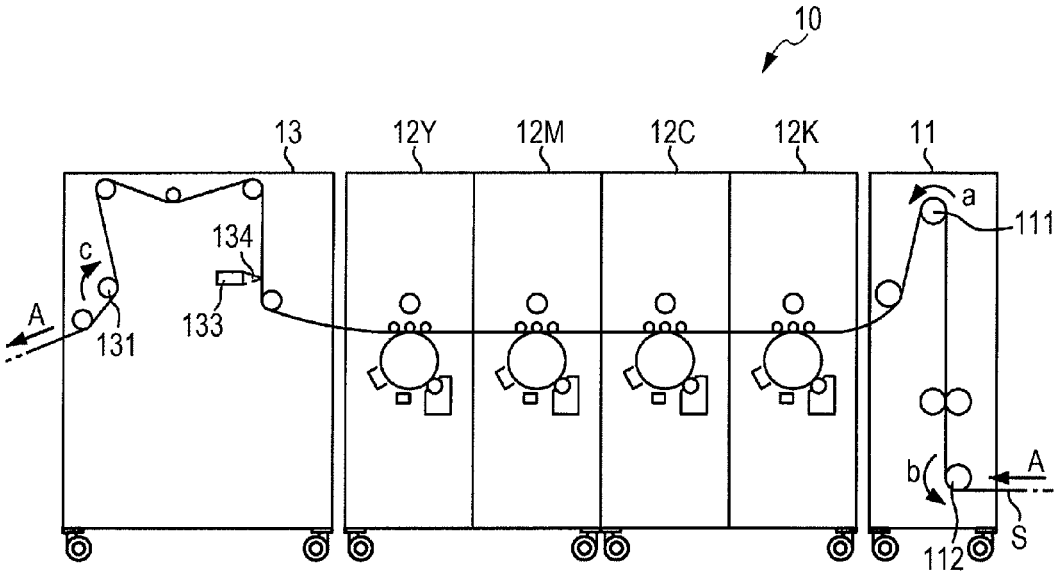
FIG. 1 is a schematic diagram illustrating the structure of an image forming apparatus according to an exemplary embodiment of the present invention.

An exemplary embodiment of the present invention will now be described with reference to the drawings. FIG. 1 is a schematic diagram illustrating the structure of an image forming apparatus 10 according to the exemplary embodiment of the present invention. In the present exemplary embodiment, the image forming apparatus 10 is a printer that is connected to a host computer (not shown) via, for example, a local area network (LAN) or a USB cable. The image forming apparatus 10 receives an image forming instruction (or job) from the host computer, and forms an image on a recording medium in accordance with the received image forming instruction. The image forming apparatus 10 may instead be a copy machine or a facsimile machine. Alternatively, the image forming apparatus 10 may have the functions of all of a printer, a copy machine, and a facsimile machine.

As illustrated in FIG. 1, the image forming apparatus 10 includes a receiving unit 11, image forming units 12Y, 12M, 12C, and 12K, and a fixing unit 13 that are connected to each other in series. The receiving unit 11 receives continuous paper S, which serves as a recording medium and continuously extends in a longitudinal direction, from a paper supply source (not shown). The image forming units 12Y, 12M, 12C, and 12K form toner images on the continuous paper S. The fixing unit 13 fixes the toner images to the continuous paper S. Plural rollers (rotating bodies) are arranged in each of the units 11, 12, and 13. The rollers are examples of a transport unit that transports the continuous paper S in the direction shown by arrow A in FIG. 1 in an image forming operation. The group of rollers and guide members (not shown) form a transport path for the continuous paper S. In FIG. 1, the shape of the transport path is shown by the continuous paper S that extends along the transport path. The operation of transporting the continuous paper S in the direction shown by arrow A in the image forming operation may be referred to as "forward transport" operation. The group of rollers that forms the transport unit is also capable of rotating in a direction opposite to that in the image forming operation to transport the continuous paper S in a direction opposite to the direction shown by arrow A. The operation of transporting the continuous paper S in the opposite direction is referred to as "back feed" operation. The direction shown by arrow A is an example of a first direction according to an exemplary embodiment of the present invention, and the direction opposite to the direction shown by arrow A is an example of a second direction according to an exemplary embodiment of the present invention.

The receiving unit 11 includes a drive roller 111, a back tension roller 112, a motor (not shown) that serves as a drive source for rotating the rollers 111 and 112, and plural rollers that are rotated by the continuous paper S that is transported. In the image forming operation, the drive roller 111 rotates in the direction shown by arrow a in FIG. 1, and thereby transports the continuous paper S supplied from the paper supply source to the image forming units 12Y, 12M, 12C, and 12K. The back tension roller 112 is positioned upstream of the drive roller 111 in a transport direction along which the continuous paper S is transported in the image forming operation. The back tension roller 112 rotates in the direction shown by arrow b to apply an appropriate tension to the continuous paper S so that the continuous paper S is transported along the transport path without becoming slack.

The image forming units 12Y, 12M, 12C, and 12K form images using toners of respective colors, which are yellow (Y), magenta (M), cyan (C), and black (K). The image forming units 12Y, 12M, 12C, and 12K have a similar structure except for the color of toner, and the image forming unit 12K illustrated in FIG. 2 will be described as an example.

Figure 2:
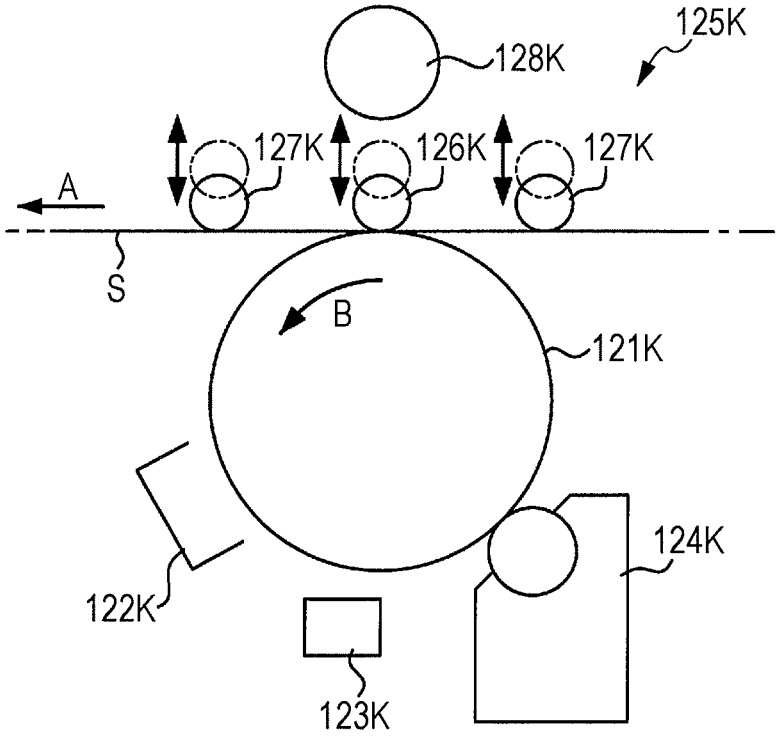
FIG. 2 is a schematic diagram illustrating the structure of an image forming unit according to the exemplary embodiment of the present invention.

As illustrated in FIG. 2, the image forming unit 12K includes a photoconductor drum 121K, which is an example of an image carrier; a charging unit 122K, an exposure unit 123K, a developing unit 124K, and a transfer unit 125K. The photoconductor drum 121K is disposed below the transport path of the continuous paper S in the direction of gravity (downward direction in FIG. 2) and is rotatable in the direction shown by arrow B. The charging unit 122K uniformly charges the surface of the photoconductor drum 121K. The exposure unit 123K forms an electrostatic latent image by irradiating the photoconductor drum 121K with light that corresponds to black (K) image data. The developing unit 124K develops the electrostatic latent image with black toner to form a toner image on the surface of the photoconductor drum 121K. The transfer unit 125K transfers the toner image onto the continuous paper S.

The transfer unit 125K includes a transfer roller 126K, which is an example of a transfer member, two transfer guide rollers 127K, a contacting-separating motor 128K, and a motor (not shown) that serves as a drive source for rotating the rollers 126K and 127K. When a transfer bias is applied between the transfer roller 126K and the photoconductor drum 121K in the state in which the continuous paper S is nipped between the transfer roller 126K and the photoconductor drum 121K, the toner image is transferred onto the continuous paper S from the photoconductor drum 121K. The two transfer guide rollers 127K guide the continuous paper S so that the continuous paper S is transported to the position between the transfer roller 126K and the photoconductor drum 121K in an ideal state. The transfer guide rollers 127K are arranged upstream and downstream of the transfer roller 126K in the transport direction of the continuous paper S in the image forming operation. The transfer roller 126K is movable between a first position (position shown by the solid line in FIG. 2) that is near the photoconductor drum 121K and a second position (position shown by the dashed line in FIG. 2) that is farther from the photoconductor drum 121K than the first position. When the transfer roller 126K is at the first position, the transfer roller 126K presses the continuous paper S against the photoconductor drum 121K. When the transfer roller 126K is at the second position, the continuous paper S is not in contact with the photoconductor drum 121K. Each of the transfer guide rollers 127K is movable between a first position (position shown by the solid line in FIG. 2) that is near the transport path of the continuous paper S and a second position (position shown by the dashed line in FIG. 2) that is farther from the transport path than the first position. The contacting-separating motor 128K moves the transfer roller 126K and the transfer guide rollers 127K between the first and second positions. A rotation shaft of the motor 128K is connected to the transfer roller 126K and the transfer guide rollers 127K with a driving-force transferring mechanism including, for example, gears, pulleys, and belts (not shown).

In the following description, the components of the image forming units 12Y, 12M, 12C, and 12K are simply denoted as a photoconductor drum 121, a charging unit 122, an exposure unit 123, a developing unit 124, and a transfer unit 125 without attaching Y, M, C, or K unless the components of the image forming units 12Y, 12M, 12C, and 12K are to be distinguished from each other.

Referring again to FIG. 1, the fixing unit 13 includes a sub-drive roller (or discharge roller) 131 driven by a motor (not shown), a laser generator 133 that emits a laser beam 134 for fixing the toner images to the continuous paper S, and plural rollers that are rotated by the continuous paper S that is transported. The sub-drive roller 131 rotates in the direction shown by arrow c to transport the continuous paper S in the direction shown by arrow A to the outside of the image forming apparatus 10. In the back feed operation of the continuous paper S, the sub-drive roller 131 is rotated in a direction opposite to the direction shown by arrow c to transport the continuous paper S in the direction opposite to the direction shown by arrow A. The continuous paper S discharged by the sub-drive roller 131 is wound around a paper take-up device (not shown). Alternatively, the continuous paper S may be cut after being discharged, and then stacked on a stacker (not shown). Perforated lines that extend in a direction that crosses the transport direction, that is, a width direction of the continuous paper S, may be formed in the continuous paper S at predetermined intervals in the transport direction of the continuous paper S, so that the continuous paper S may be easily cut. In the case where the perforated lines are formed in the continuous paper S, the continuous paper S may be placed on the stacker in a manner such that the continuous paper S is folded along the perforated lines.

The laser generator 133 irradiates the transported continuous paper S with the laser beam 134 over the entire width of the area in which an image is formed on the continuous paper S. The laser generator 133 may include plural laser sources (for example, semiconductor lasers such as edge emitting lasers (EEL) or vertical cavity surface emitting lasers (VCSEL)) that are arranged in the width direction of the continuous paper S, that is, in the direction that crosses the transport direction. In such a case, distribution of the irradiation energy of the laser beam 134 is made more uniform over the entire width of the area in which the image is transferred onto the continuous paper S. The laser generator 133 may also include optical members, such as lenses, for causing the laser beam emitted from each laser source to converge or diverge. The toner on the continuous paper S that passes through an irradiation area of the laser beam 134 that is emitted from the laser generator 133 is heated and melted by the laser beam 134, and is thereby fixed to the continuous paper S. The intensity of the laser beam 134 emitted by the laser generator 133 is controlled by the controller 200, which will be described below. More specifically, the controller 200 controls the intensity of the laser beam 134 emitted from the laser generator 133 by adjusting the voltage or current applied to the laser generator 133. The laser generator 133 is an example of a light irradiating unit according to an exemplary embodiment of the present invention.

Figure 3:
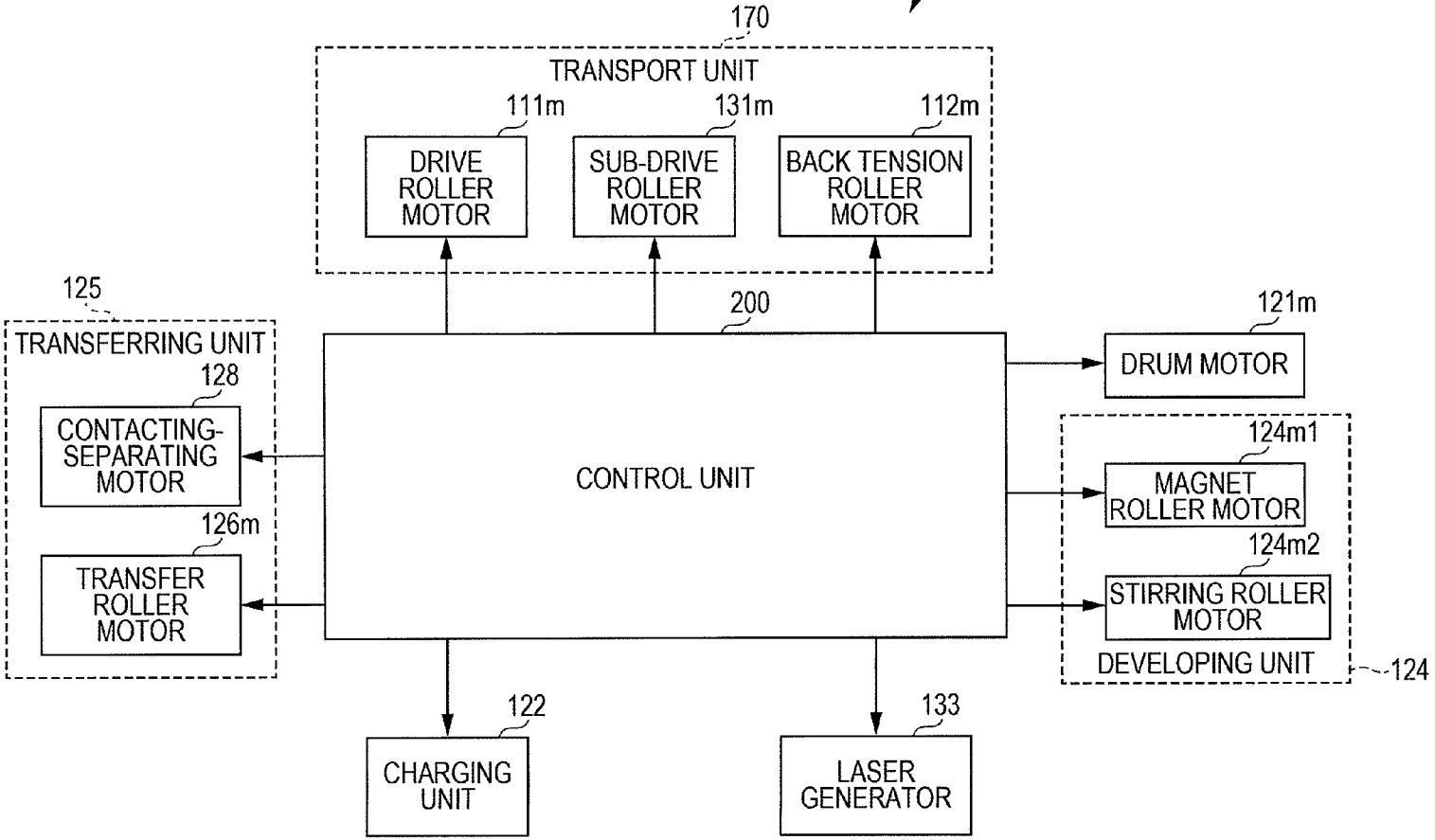
FIG. 3 is a block diagram illustrating the structure of a control system in the image forming apparatus according to the exemplary embodiment of the present invention.

FIG. 3 is a block diagram illustrating the structure of a control system in the image forming apparatus 10. The controller 200 includes a central processing unit (CPU), a read only memory (ROM), and a random access memory (RAM), and is installed in one of the receiving unit 11, the image forming units 12Y, 12M, 12C, and 12K, and the fixing unit 13. The CPU included in the controller 200 executes control programs stored in the ROM to control components, such as a drum motor 121*m*, the charging unit 122, the developing unit 124, the transfer unit 125, the laser generator 133, and a transport unit 170, of the image forming apparatus 10. The drum motor 121*m* is a drive unit that rotates the photoconductor drum 121. The developing unit 124 includes a magnet roller motor 124*m*1, which is a drive unit that rotates a magnet roller in a developer container included in the developing unit 124, and a stirring roller motor 124*m*2, which is a drive unit that rotates a stirring roller in the developer container. The transfer unit 125 includes the above-described contacting-separating motor 128 and a transfer roller motor 126*m*, which is a drive unit that rotates the transfer roller 126. The transport unit 170 includes a drive roller motor 111*m*, which is a drive unit that rotates the drive roller 111, a back tension roller motor 112*m*, which is a drive unit that rotates the back tension roller 112, and a sub-drive roller motor 131*m*, which is a drive unit that rotates the sub-drive roller 131.

Operation

Referring to the timing chart of FIG. 4, operations performed by the controller 200 to control the transport of the continuous paper S and the intensity of the laser beam 134 emitted from the laser generator 133 will be described. When the controller 200 receives an image forming instruction from the host computer, the controller 200 controls the components of the image forming apparatus 10 to form an image on the continuous paper S in accordance with the image forming instruction. The image forming instruction includes image data corresponding to images of one or more pages.

Figure 4:
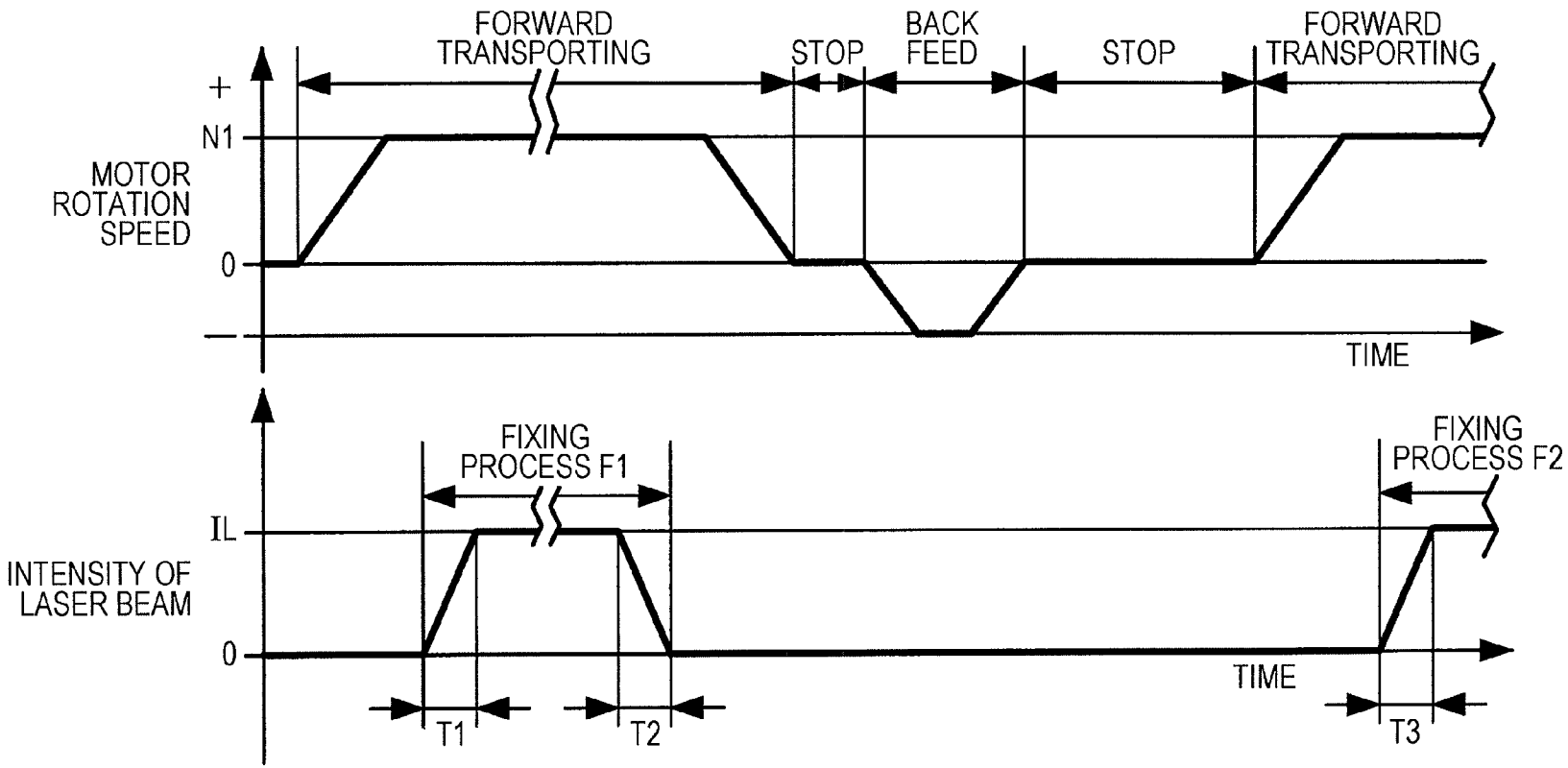
FIG. 4 is a timing chart illustrating the operation of the image forming apparatus according to the exemplary embodiment of the present invention.

In FIG. 4, the upper chart shows the rotation speed of the drive roller motor 111*m* that drives the drive roller 111. The positive side of the chart shows the rotation direction of the drive roller 111 in the image forming operation in which the continuous paper S is transported forward, that is, the direction shown by arrow a in FIG. 1. The negative side of the chart shows the rotation direction of the drive roller 111 in the back feed operation of the continuous paper S, that is, the direction opposite to the direction shown by arrow a in FIG. 1. The lower chart in FIG. 4 shows the intensity of the laser beam 134 emitted from the laser generator 133. Although the rotation speed of only the drive roller motor 111*m* is shown in FIG. 4, the back tension roller motor 112*m* and the sub-drive roller motor 131*m* may be operated in association with the operation of the drive roller motor 111*m*.

Referring to FIG. 4, when the controller 200 receives an image forming instruction INS1 from the host computer, the controller 200 performs the forward transport operation of the continuous paper S by rotating the drive roller motor 111*m* in the direction shown by arrow a at a rotation speed N1. More specifically, the controller 200 gradually increases the rotation speed of the drive roller motor 111*m* to the rotation speed N1, and maintains the rotation speed of the drive roller motor 111*m* as constant as possible at the rotation speed N1. In addition, the controller 200 controls each image forming unit 12 so as to form a toner image based on the image data included in the image forming instruction INS1 and transfer the toner image onto the continuous paper S that is being transferred. The controller 200 may cause each image forming unit 12 to start forming the toner image before the drive roller motor 111*m* is activated, so that the image forming unit 12 may be ready to start transferring the toner image onto the continuous paper S immediately after the rotation speed of the drive roller motor 111*m* is stabilized, that is, immediately after the transport speed of the continuous paper S is stabilized.

In addition, to perform a fixing process F1 (example of a first fixing process) for fixing the toner images that have been transferred onto the continuous paper S in accordance with the image forming instruction INS1, the controller 200 controls the laser generator 133 so that the laser generator 133 emits the laser beam 134 at a predetermined intensity IL. As illustrated in FIG. 4, in a predetermined period T1 from the start of the fixing process F1, the controller 200 controls the laser generator 133 so that the intensity of the laser beam 134 emitted from the laser generator 133 gradually increases from zero, which corresponds to the state in which the laser beam 134 is not emitted from the laser generator 133, to the intensity IL with a predetermined slope. In addition, in a predetermined period T2 before the end of the fixing process F1, the controller 200 controls the laser generator 133 so that the intensity of the laser beam 134 emitted from the laser generator 133 gradually decreases from the intensity IL to zero with a predetermined slope. If no image forming instruction for the continuous paper S is issued before the image forming instruction INS1, the laser generator 133 may be controlled so as to emit the laser beam 134 at the intensity IL without gradually increasing the intensity of the laser beam 134 in the period T1.

After the fixing process F1 based on the image forming instruction INS1 is ended, the controller 200 stops the drive roller motor 111*m*. Then, the controller 200 rotates the drive roller motor 111*m* in the reverse direction to perform the back feed operation of the continuous paper S, and stops the drive roller motor 111*m* again. As a result of the back feed operation of the continuous paper S, a wasted space between the image formed on the continuous paper S in accordance with the image forming instruction INS1 and an image formed on the continuous paper S in accordance with an image forming instruction INS2 that is subsequent to the image forming instruction INS1 may be eliminated or reduced.

As described above, in the predetermined period T2 before the end of the fixing process F1, the intensity of the laser beam 134 emitted from the laser generator 133 is gradually reduced from the intensity IL to zero with a predetermined slope. Accordingly, a part of the toner on the continuous paper S that is irradiated with the laser beam 134 in the period T2 is not sufficiently fixed. Therefore, in the back feed operation of the continuous paper S, the controller 200 controls the contacting-separating motor 128 so as to move the transfer roller 126 and the transfer guide rollers 127 to the second positions to prevent the toner that is not sufficiently fixed from coming into contact with the photoconductor drum 121 in each image forming unit 12.

Referring to FIG. 4, when the controller 200 receives the subsequent image forming instruction INS2, the controller 200 performs the forward transport operation of the continuous paper S by rotating the drive roller motor 111*m* in the direction shown by arrow a at the rotation speed N1. In addition, the controller 200 controls each image forming unit 12 so as to form a toner image based on the image data included in the image forming instruction INS2 and transfer the toner image onto the continuous paper S.

In addition, to perform a fixing process F2 (example of a second fixing process) for fixing the toner images that have been transferred onto the continuous paper S in accordance with the image forming instruction INS2, the controller 200 controls the laser generator 133 so that the laser generator 133 emits the laser beam 134 at a predetermined intensity IL. As illustrated in FIG. 4, in a predetermined period T3 from the start of the fixing process F2, the controller 200 controls the laser generator 133 so that the intensity of the laser beam 134 emitted from the laser generator 133 gradually increases from zero to the intensity IL with a predetermined slope.

The controller 200 controls the time at which the fixing process F2 is started, that is, the time at which the emission of the laser beam 134 from the laser generator 133 is started in the fixing process F2, as follows. That is, the time is controlled such that an area of the continuous paper S that is irradiated with the laser beam 134 emitted from the laser generator 133 in the fixing process F2 (fixing area denoted by R2 in FIG. 5) and an area of the continuous paper S that is irradiated with the laser beam 134 emitted from the laser generator 133 in the fixing process F1 performed prior to the fixing process F2 (fixing area denoted by R1 in FIG. 5) partially overlap. In this example, the length of the predetermined period T3 after the start of the fixing process F2 is equal to the length of the predetermined period T2 before the end of the fixing process F1. The rotation speed of the drive roller motor 111*m* is maintained at the rotation speed N1 in the periods T2 and T3, and the transport speed of the continuous paper S corresponds to the rotation speed of the drive roller motor 111*m*. Therefore, the length in the transport direction of the area of the continuous paper S irradiated with the laser beam 134 in the period T2 (hereinafter referred to as a fixing area R11) is substantially equal to the length in the transport direction of the area of the continuous paper S irradiated with the laser beam 134 in the period T3 (hereinafter referred to as a fixing area R21). The controller 200 controls the time at which the fixing process F2 is started so that the fixing area R11 and the fixing area R21 completely overlap, that is, so that the fixing area R11 and the fixing area R21 coincide with each other.

Figure 5A:
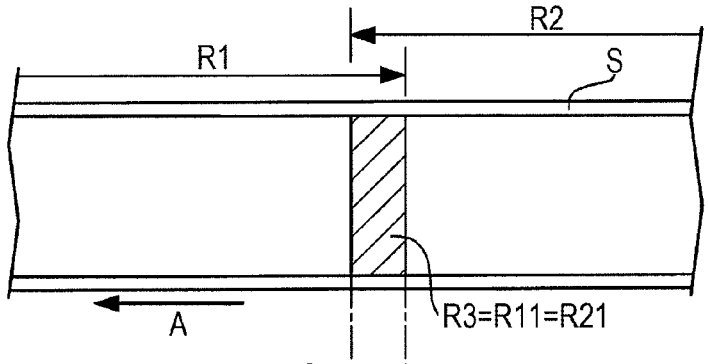
FIGS. 5A, 5B, and 5C illustrate the distribution of fixing energy applied to continuous paper in an overlapping area between fixing areas and areas around the overlapping area on the continuous paper in the image forming apparatus according to the exemplary embodiment of the present invention and a comparative example.

FIG. 5A illustrates the fixing areas R1 and R2 of the continuous paper S that are defined in accordance with the timing chart of FIG. 4 and an overlapping area R3 in which the fixing areas R1 and R2 overlap. As described above, the fixing area R1 is an area of the continuous paper S that is irradiated with the laser beam 134 in the fixing process F1, and the fixing area R2 is an area of the continuous paper S that is irradiated with the laser beam 134 in the fixing process F2. In FIG. 5A, the arrow A shows the transport direction in which the continuous paper S is transported in the image forming operation. In this example, as described above, the controller 200 controls the time at which the fixing process F2 is started so that the fixing area R11, which is the area of the continuous paper S that is irradiated with the laser beam 134 in the period T2, and the fixing area R21, which is the area of the continuous paper S that is irradiated with the laser beam 134 in the period T3, completely overlap. Therefore, the overlapping area R3 in which the fixing areas R1 and R2 overlap coincides with the fixing area R11 and the fixing area R21 (R3=R11=R21).

Figure 5B:
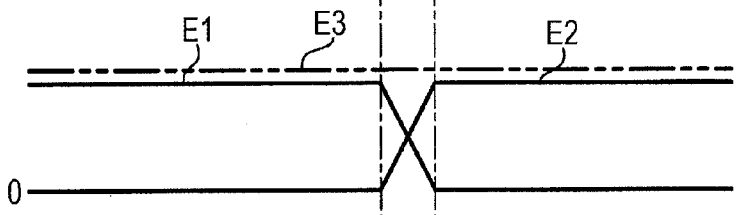

FIG. 5B illustrates the distribution in the transport direction of the continuous paper S of energy (hereinafter referred to as fixing energy) applied to the continuous paper S by the laser beam 134 from the laser generator 133 in the overlapping area R3 and areas around the overlapping area R3. As illustrated in FIG. 5B, the fixing energy E1 applied to the continuous paper S by the laser generator 133 in the fixing process F1 is maintained at a level that corresponds to the intensity IL of the laser beam 134 in the part of the fixing area R1 excluding the overlapping area R3. In the overlapping area R3, the intensity of the laser beam 134 gradually decreases in the period T2. Accordingly, the fixing energy E1 gradually decreases in a direction opposite to the transport direction of the continuous paper S (direction shown by arrow A). The fixing energy E2 applied to the continuous paper S by the laser generator 133 in the fixing process F2 is maintained at the level that corresponds to the intensity IL of the laser beam 134 in the part of the fixing area R2 excluding the overlapping area R3. In the overlapping area R3, the intensity of the laser beam 134 gradually increases in the period T3. Accordingly, the fixing energy E2 gradually increases in the direction opposite to the transport direction of the continuous paper S. Accordingly, the fixing energy E3 (=E1+E2) that is applied to the continuous paper S during the fixing processes F1 and F2 does not change between the overlapping area R3 and the other areas, as shown by the two-dot chain line in FIG. 5B. Therefore, excessive melting of the toner in the overlapping area R3 may be suppressed. As a result, differences in image density or glossiness between the overlapping area R3 and the other areas due to excessive melting of the toner in the overlapping area R3 may be reduced. In FIG. 5B, for convenience of explanation, even in areas in which the fixing energy E3 is equal to the fixing energy E1 or E2, the line that shows the fixing energy E3 and the line that show the fixing energy E1 or E2 are drawn at different heights so that the lines do not overlap.

Figure 5C:
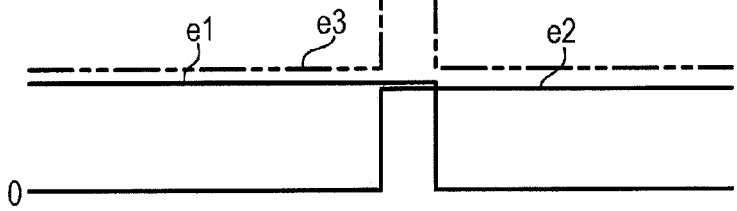

FIG. 5C illustrates the distribution in the transport direction of the continuous paper S of the fixing energy applied to the continuous paper S by the laser generator 133 in the overlapping area R3, in which the fixing areas R1 and R2 overlap, and areas around the overlapping area R3 according to a comparative example. In the comparative example, the intensity of the laser beam 134 is not gradually reduced in the period T2 in the fixing process F1 or increased in the period T3 in the fixing process F2. In other words, in the comparative example, the intensity of the laser beam 134 is not changed from the intensity IL. In the example illustrated in FIG. 5C, the fixing energy e1 applied to the continuous paper S by the laser generator 133 in the fixing process F1 is maintained at the level corresponding to the intensity IL of the laser beam 134 over the fixing area R1 including the overlapping area R3. Similarly, the fixing energy e2 applied to the toner on the continuous paper S by the laser generator 133 in the fixing process F2 is maintained at the level corresponding to the intensity IL of the laser beam 134 over the fixing area R2 including the overlapping area R3. Accordingly, the fixing energy e3 (=e1+e2) that is applied to the continuous paper S during the fixing processes F1 and F2 is increased (by a factor of 2) in the entire overlapping area R3 compared to the fixing energy e3 in the other areas, as shown by the two-dot chain line in FIG. 5C. Therefore, excessive melting of the toner occurs in the overlapping area R3. In addition, differences in image density or glossiness are caused by the excessive melting of the toner.

Modifications

The above-described exemplary embodiment may be modified as described below. The modifications described below may be implemented in combination as necessary.

First Modification

Figure 6A:
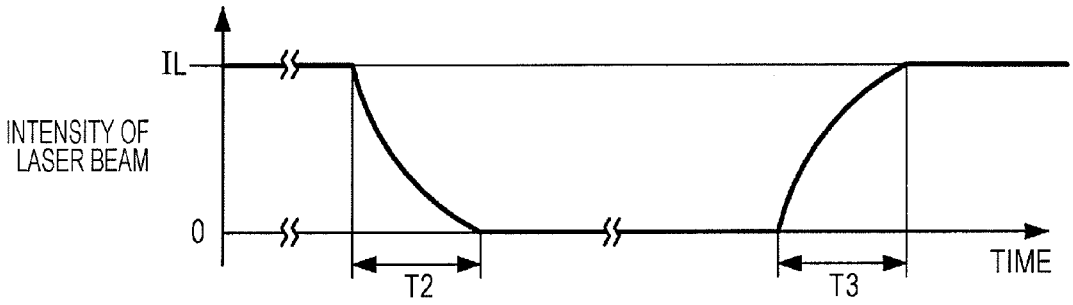
FIGS. 6A, 6B, and 6C are graphs illustrating the intensity control of a laser beam emitted by a laser generator according to a modification.
Figure 6B:
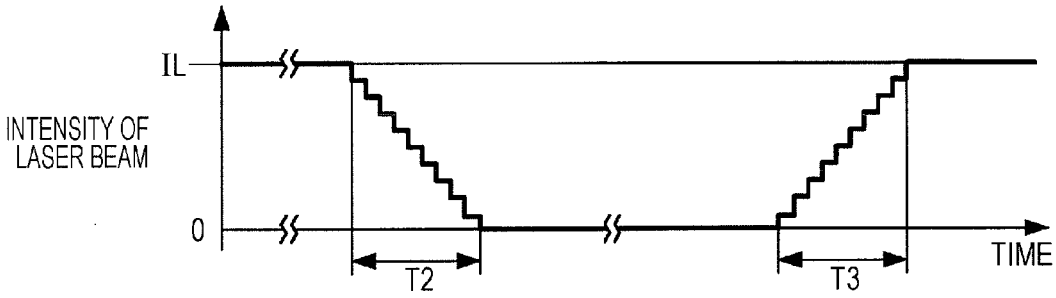
Figure 6C:
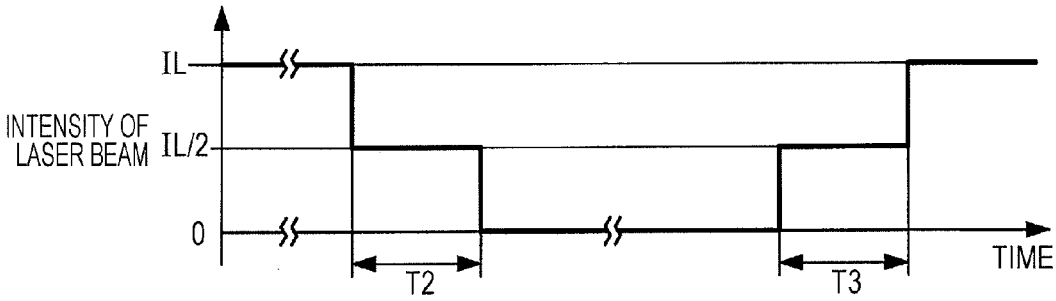

In the above-described exemplary embodiment, the laser generator 133 is controlled so that the intensity of the laser beam 134 emitted from the laser generator 133 gradually decreases from the intensity IL to zero with a predetermined slope, that is, linearly, in the predetermined period T2 before the end of the fixing process F1. In addition, the laser generator 133 is controlled so that the intensity of the laser beam 134 emitted from the laser generator 133 gradually increases from zero to the intensity IL with a predetermined slope in the predetermined period T3 after the start of the fixing process F2. However, the present invention is not limited to this. For example, as illustrated in FIG. 6A, the laser generator 133 may be controlled so that the intensity of the laser beam 134 emitted from the laser generator 133 change along curves in the periods T2 and T3. Alternatively, as illustrated in FIG. 6B, the laser generator 133 may be controlled so that the intensity of the laser beam 134 emitted from the laser generator 133 change stepwise in the periods T2 and T3. Alternatively, as illustrated in FIG. 6C, the laser generator 133 may be controlled so that the intensity of the laser beam 134 emitted from the laser generator 133 is maintained at a predetermined intensity that is lower than the intensity IL (for example, IL/2) in the periods T2 and T3. In any case, the laser generator 133 may be controlled so that the intensity of the laser beam 134 emitted from the laser generator 133 is lower than the predetermined intensity IL in each of the periods T2 and T3.

In the example of FIG. 6C, the intensity of the laser beam 134 in the period T2 and the intensity of the laser beam 134 in the period T3 are not limited to IL/2 as long as the intensity of the laser beam 134 in the period T2 and the intensity of the laser beam 134 in the period T3 are both lower than the predetermined density IL. For example, the intensity of the laser beam 134 in the period T2 may be set to IL/3, and the intensity of the laser beam 134 in the period T3 may be set to IL·(2/3). The sum of the intensity of the laser beam 134 in the period T2 and the intensity of the laser beam 134 in the period T3 may be set as close to the predetermined intensity IL as possible.

In the case where the laser generator 133 is controlled so that the intensity of the laser beam 134 emitted from the laser generator 133 gradually decreases from the intensity IL to zero in the period T2 and gradually increases from zero to the intensity IL in the period T3 as illustrated in FIGS. 6A, 6B, and 4, the following advantage may be obtained. That is, compared to the case in which the intensity of the laser beam 134 is maintained at an intensity lower than the predetermined intensity IL in periods T2 and T3 as illustrated in FIG. 6C, variation in the fixing energy applied to the continuous paper S may be reduced when the area of the continuous paper S irradiated with the laser beam 134 in the period T2 (area R11 in FIG. 5) and the area of the continuous paper S irradiated with the laser beam 134 in the period T3 (area R21 in FIG. 5) are shifted from each other in the transport direction of the continuous paper S.

Second Modification

In the above-described exemplary embodiment, when the length of the period T2 before the end of the fixing process F1 and the length of the period T3 after the start of the fixing process F2 are equal to each other, the controller 200 controls the time at which the fixing process F2 is started so that the fixing area R11, which is the area of the continuous paper S that is irradiated with the laser beam 134 in the period T2, and the fixing area R21, which is the area of the continuous paper S that is irradiated with the laser beam 134 in the period T3, completely overlap. However, the present invention is not limited to this. The fixing area R11 and the fixing area R21 may be shifted from each other in the transport direction so as to partially overlap.

Figure 7A:
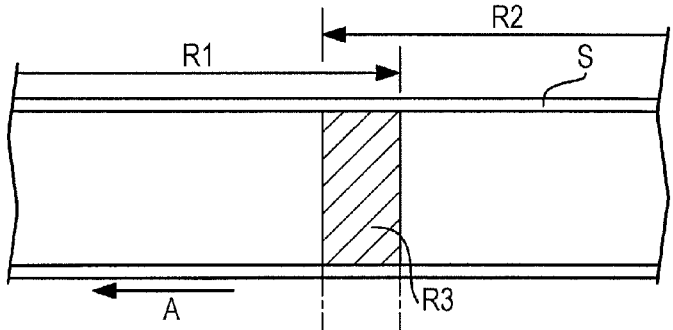
FIGS. 7A and 7B illustrate the distribution of fixing energy applied to continuous paper in an overlapping area between fixing areas and areas around the overlapping area on the continuous paper in an image forming apparatus according to a second modification.
Figure 7B:
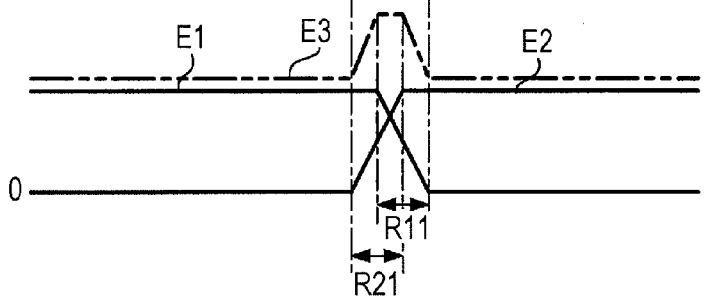

FIGS. 7A and 7B are diagrams corresponding to FIGS. 5A and 5B, respectively, and illustrate the case in which the time at which the fixing process F2 is started is advanced from that in the example illustrated in FIGS. 5A and 5B. The example illustrated in FIGS. 7A and 7B is similar to the above-described exemplary embodiment except for the time at which the fixing process F2 is started. In FIGS. 7A and 7B, parts similar to those in FIGS. 5A and 5B are denoted by the same reference numerals, and detailed explanations thereof are thus omitted.

In this example, as illustrated in FIG. 7B, since the time at which the fixing process F2 is started is advanced, the front part of the area R21 in the transport direction overlaps the part of the area R1 in which the fixing energy E1 is maintained at the level corresponding to the intensity IL of the laser beam 134. In addition, the front part of the fixing area R11 in the transport direction overlaps the rear part of the fixing area R21 in the transport direction, and the rear part of the fixing area R11 in the transport direction overlaps the part of the fixing area R2 in which the fixing energy E2 is maintained at the level corresponding to the intensity IL of the laser beam 134. As a result, in the example illustrated in FIGS. 7A and 7B, the fixing energy E3 that is applied to the continuous paper S during the fixing processes F1 and F2 is increased in the overlapping area R3 compared to that in the other areas, as shown by the two-dot chain line in FIG. 7B. However, in the example illustrated in FIGS. 7A and 7B, the fixing energy in the fixing area R11 gradually decreases in the direction opposite to the transport direction of the continuous paper S (direction shown by arrow A) as the intensity of the laser beam 134 gradually decreases in the period T2. In addition, the fixing energy in the fixing area R21 gradually increases in the direction opposite to the transport direction of the continuous paper S as the intensity of the laser beam 134 gradually increases in the period T3. Therefore, compared to the case illustrated in FIG. 5C in which the fixing energy does not gradually decrease or increase, the amount of increase in the fixing energy in the overlapping area R3 is reduced. Accordingly, excessive melting of the toner in the overlapping area R3 may be suppressed.

In the case where the time at which the fixing process F2 is started is delayed from that in the example illustrated in FIGS. 5A and 5B, the fixing energy decreases in the overlapping area R3 compared to that in the other areas, in contrast to the example illustrated in FIGS. 7A and 7B. However, the time at which the fixing process F2 is started may be delayed as long as the reduction in the fixing energy does not cause fixing failure of the toner on the continuous paper S.

Third Modification

In the above-described exemplary embodiment, the length of the predetermined period T2 before the end of the fixing process F1 is equal to the length of the predetermined period T3 after the start of the fixing process F2. In other words, the length of the fixing area R11 of the continuous paper S in the transport direction is equal to the length of the fixing area R21 of the continuous paper S in the transport direction. However, the present invention is not limited to this, and the periods T2 and T3 may have different lengths.

Figure 8A:
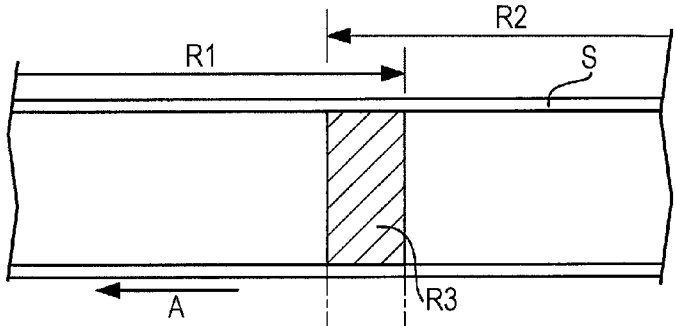
FIGS. 8A and 8B illustrate the distribution of fixing energy applied to continuous paper in an overlapping area between fixing areas and areas around the overlapping area on the continuous paper in an image forming apparatus according to a third modification.
Figure 8B:
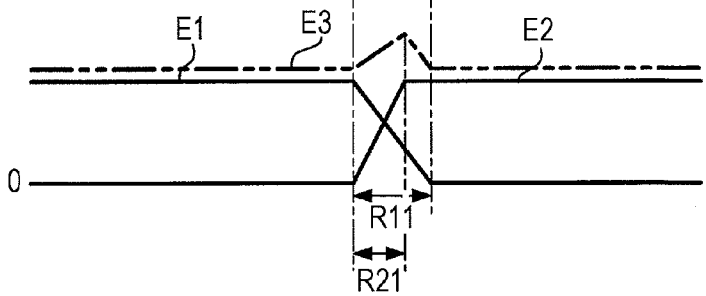

FIGS. 8A and 8B are diagrams corresponding to FIGS. 5A and 5B, respectively, and illustrate the case in which the period T2 is longer than the period T3. In FIGS. 8A and 8B, parts similar to those in FIGS. 5A and 5B are denoted by the same reference numerals, and detailed explanations thereof are thus omitted.

In this example, as illustrated in FIG. 8B, since the period T2 is longer than the period T3, the length in the transport direction of the fixing area R11, which is the area of the continuous paper S that is irradiated with the laser beam 134 in the period T2, is larger than the length in the transport direction of the fixing area R21, which is the area of the continuous paper S that is irradiated with the laser beam 134 in the period T3. In the example illustrated in FIGS. 8A and 8B, the time at which the fixing process F2 is started is controlled so that the front ends of the fixing areas R11 and R21 in the transport direction are at the same position. Therefore, as illustrated in FIG. 8B, the rear part of the fixing area R11 in the transport direction does not overlap the fixing area R21, but overlaps the part of the fixing area R2 in which the fixing energy E2 is maintained at the level corresponding to the intensity IL of the laser beam 134. As a result, in the example illustrated in FIGS. 8A and 8B, the fixing energy E3 that is applied to the continuous paper S during the fixing processes F1 and F2 is increased in the overlapping area R3 compared to that in the other areas, as shown by the two-dot chain line in FIG. 8B. However, in the example illustrated in FIGS. 8A and 8B, the fixing energy in the fixing area R11 gradually decreases in the direction opposite to the transport direction of the continuous paper S (direction shown by arrow A) as the intensity of the laser beam 134 gradually decreases in the period T2. In addition, the fixing energy in the fixing area R21 gradually increases in the direction opposite to the transport direction of the continuous paper S as the intensity of the laser beam 134 gradually increases in the period T3. Therefore, compared to the case illustrated in FIG. 5C in which the fixing energy does not gradually decrease or increase, the amount of increase in the fixing energy in the overlapping area R3 is reduced. Accordingly, excessive melting of the toner in the overlapping area R3 may be suppressed.

In the case where the time at which the fixing process F2 is started is delayed from that in the example illustrated in FIGS. 8A and 8B, the front part of the fixing area R11 in the transport direction does not overlap the fixing area R2. Therefore, the fixing energy decreases at the front part of the fixing area R11 in the transport direction compared to that in the other areas. However, the time at which the fixing process F2 is started may be delayed as long as the reduction in the fixing energy does not cause fixing failure of the toner on the continuous paper S.

Although the case in which the period T2 is longer than the period T3 is illustrated in FIGS. 8A and 8B, the period T2 may instead be shorter than the period T3. The difference between the period T2 and the period T3 may be set within a predetermined range in which the difference does not cause excessive or insufficient fixing energy in the overlapping area R3 that leads to excessive melting or fixing failure of the toner.

Fourth Modification

In the fixing process F1 based on the image forming instruction INS1 according to the above-described exemplary embodiment, all of the one or more images that have been transferred onto the continuous paper S in accordance with the image forming instruction INS1 may be fixed. Alternatively, the one or more images that have been transferred onto the continuous paper S may be partially left in an unfixed state. In either case, as described above, the time at which the fixing process F2 based on the image forming instruction INS2 that is subsequent to the image forming instruction INS1 is started is controlled so that the area of the continuous paper S that is irradiated with the laser beam 134 from the laser generator 133 in the fixing process F2 partially overlaps the area of the continuous paper S that is irradiated with the laser beam 134 from the laser generator 133 in the fixing process F1 that is performed prior to the fixing process F2.

Fifth Modification

In the above-described exemplary embodiment, the toner image is fixed to the continuous paper S by irradiating the toner image with the laser beam. However, flash light emitted from a flash lamp, such as a xenon lamp, may be used in place of the laser beam. In such a case, the intensity of the irradiation light is controlled by adjusting, for example, a voltage applied to the flash lamp.

Sixth Modification

In the image forming apparatus 10 according to the above-described exemplary embodiment, the image is directly transferred onto the continuous paper S from the photoconductor drum 121 in each image forming unit 12. However, the image may instead be transferred by using an intermediate transfer belt. In other words, the transfer unit may include an intermediate transfer belt.

Seventh Modification

The controller 200 may include an application specific integrated circuit (ASIC). In such a case, the functions of the controller 200 may be achieved by the ASIC or by both the CPU and the ASIC.

Eighth Modification

Programs for realizing the functions of the controller 200 may be provided in the state in which the programs are stored in a computer-readable recording medium, and be installed into the image forming apparatus 10. Examples of the computer-readable recording medium include a magnetic recording medium such as a magnetic tape and a magnetic disc (HDD, flexible disk (FD), etc.), an optical recording medium such as an optical disc (compact disc (CD), digital versatile disk (DVD), etc.), a magneto optical recording medium, and a semiconductor memory. Alternatively, the programs may be downloaded via a communication line and installed into the image forming apparatus 10.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An optical fixing apparatus comprising:

a transport unit that transports a recording medium that carries an image transferred onto the recording medium in a first direction in a first fixing process and a second fixing process subsequent to the first fixing process and transports the recording medium in a second direction after the first fixing process and before the second fixing process, the second direction being opposite to the first direction;

a light irradiating unit that irradiates the recording medium with light having a predetermined intensity while the recording medium is transported in the first direction by the transport unit in the first fixing process and the second fixing process; and a controller that controls the light irradiating unit so that the intensity of the light from the light irradiating unit is lower than the predetermined intensity in a predetermined first period before the end of the first fixing process and a predetermined second period after the start of the second fixing process, and so that an area of the recording medium that is irradiated with the light from the light irradiating unit in the first period and an area of the recording medium that is irradiated with the light from the light irradiating unit in the second period overlap.

2. The optical fixing apparatus according to claim 1, wherein the controller controls the light irradiating unit so that the intensity of the light from the light irradiating unit decreases in the first period and increases in the second period.

3. The optical fixing apparatus according to claim 1, wherein the difference between the length of the first period and the length of the second period is within a predetermined range.

4. The optical fixing apparatus according to claim 2, wherein the difference between the length of the first period and the length of the second period is within a predetermined range.

5. An image forming apparatus comprising:

an image carrier;

a charging unit that charges the image carrier;

an exposure unit that forms an electrostatic latent image by subjecting the image carrier charged by the charging unit to an exposure process that corresponds to image data;

a developing unit that forms an image on a surface of the image carrier by developing the electrostatic latent image formed by the exposure unit;

a transfer unit that transfers the image formed on the surface of the image carrier onto a recording medium; and the optical fixing apparatus according to claim 1, the optical fixing apparatus fixing the image transferred onto the recording medium to the recording medium.

6. An optical fixing method comprising:

transporting a recording medium that carries an image transferred onto the recording medium in a first direction in a first fixing process and a second fixing process subsequent to the first fixing process and transporting the recording medium in a second direction after the first fixing process and before the second fixing process, the second direction being opposite to the first direction;

causing a light irradiating unit to irradiate the recording medium with light having a predetermined intensity while the recording medium is transported in the first direction in the first fixing process and the second fixing process; and controlling the light irradiating unit so that the intensity of the light from the light irradiating unit is lower than the predetermined intensity in a predetermined first period before the end of the first fixing process and a predetermined second period after the start of the second fixing process, and so that an area of the recording medium that is irradiated with the light from the light irradiating unit in the first period and an area of the recording medium that is irradiated with the light from the light irradiating unit in the second period overlap.

* * * * *